US006139108A

United States Patent [19]

Schneider

[11] Patent Number: 6,139,108

[45] Date of Patent: Oct. 31, 2000

[54] CHAIR FRAME

[76] Inventor: Wallace Schneider, 41 W. 72nd St., 8A, New York, N.Y. 10023-3483

[21] Appl. No.: 09/436,732

[22] Filed: Nov. 9, 1999

[51] Int. Cl.[7] ..... A47C 3/00

[52] U.S. Cl. ..... 297/447.4; 297/446.1

[58] Field of Search ..... 297/59, 446.1, 297/446.2, 447.4

[56] References Cited

U.S. PATENT DOCUMENTS

| | | | |
|---|---|---|---|
| D. 155,880 | 11/1949 | Erwin | 297/446.1 X |
| 365,999 | 7/1887 | Hogberg | 297/447.4 |
| 951,035 | 3/1910 | Wanner, Jr. | 297/447.4 X |
| 2,936,009 | 5/1960 | McGuire | 297/446.1 X |
| 3,113,802 | 12/1963 | Goldsholl et al. | 297/59 X |
| 3,901,551 | 8/1975 | Wiesner | 297/447 |
| 4,014,591 | 3/1977 | Gittings | 297/55 |
| 4,359,244 | 11/1982 | Koehm | 297/16 |
| 4,585,270 | 4/1986 | Singer | 297/16 |
| 4,614,378 | 9/1986 | Picou | 297/92 |
| 4,652,047 | 3/1987 | Chan | 297/45 |
| 5,718,473 | 2/1998 | Lynch, Jr. | 297/16.2 |

FOREIGN PATENT DOCUMENTS

| | | | |
|---|---|---|---|
| 2517945 | 6/1983 | France | 297/446.1 |
| 532850 | 1/1941 | United Kingdom | 297/446.1 |

*Primary Examiner*—Peter R. Brown
*Attorney, Agent, or Firm*—Richard L. Miller

[57] ABSTRACT

A chair frame that includes a seat portion, a seat back portion extending upwardly from the seat portion, a plurality of legs depending from the seat portion, and bracing extending from the plurality of legs. The seat portion includes a front seat rail, a rear seat rail, and a pair of side seat rails that form a continuous rectilinear configuration for the seat portion. The seat back portion includes a pair of stiles and a back rail, and together with the rear seat rail, forms a continuous rectilinear configuration for the seat back portion. The plurality of legs include a pair of front legs and a pair of back legs. The bracing includes a rear stretcher and a pair of diagonal braces. Each diagonal brace extends from the free terminal end of an associated rear leg to the midpoint of the front seat rail, and together with the rear stretcher of the bracing, forms a triangular configuration for the bracing.

5 Claims, 1 Drawing Sheet

CHAIR FRAME

BACKGROUND OF THE INVENTION

1. Field of the Invention

The present invention relates to a frame. More particularly, the present invention relates to a chair frame.

2. Description of the Prior Art

Leaning back in a chair with conventional parallel horizontal bracing to strengthen the legs is likely to lead to the fracturing of the joint between the seat and the back of the chair.

There exists, therefore a need for bracing to strengthen the legs of chair that will prevent fracturing between the seat and the back of the chair when leaning back in the chair.

Numerous innovations for chairs have been provided in the prior art that will be described. Even though these innovations may be suitable for the specific individual purposes to which they address, however, they differ from the present invention in that they do not teach bracing to strengthen the legs of chair that will prevent fracturing between the seat and the back of the chair when leaning back in the chair.

A FIRST EXAMPLE, U.S. Pat. No. 3,901,551 to Wiesner teaches a stressed structure assembly providing support for a predetermined maximum weight, such as a chair having a framework supporting a seat. Framework members are assembled so that each member is in pure compression or tension. Framework member configuration is of comparatively light cross section due to the absence of necessity for supporting bending stress. The framework includes means for supporting the assembly on a surface which is conformable to irregularities in the surface.

A SECOND EXAMPLE, U.S. Pat. No. 4,014,591 to Gittings teaches a collapsible chair providing a lightweight, strong, and sturdy chair when unfolded and providing a compact elongated structure when collapsed. The collapsible chair includes a fabric seat supported in suspended relationship at four corners by a frame assembly comprised of a plurality of legs pivotably connected together. The frame assembly includes a pair of pivotal crossed rear brace legs and a pair of pivotal crossed front brace legs joined by a pair of brace leg assemblies which define the opposite sides of the frame. The pair of brace leg assemblies each include three pivotally connected brace legs, two of these brace legs of each pair of assemblies being connected by a pivotable stop link which permits relative pivotal movement of these brace legs and provides a means for restraining the three brace legs in their proper positions when the chair is in its open position. The ends of the pivotally crossed rear brace legs and the ends of the pivotally crossed front brace legs are pivotally joined to the side frame assemblies by angular brackets which permit simultaneous relative pivotal movement of the two connected brace legs about perpendicular axes, and thereby facilitating collapse of the chair in two dimensions simultaneously to form an elongated compact assembly of nearly parallel brace legs.

A THIRD EXAMPLE, U.S. Pat. No. 4,359,244 to Koehm teaches a folding chair having a frame which permits said chair to be easily and conveniently folded into a compact configuration that facilitates both the storage and transport thereof. The frame of the instant folding chair includes a triangular-shaped seat support structure and an arrangement of legs that are spaced relative to one another in positions that correspond to the vertices of a triangle. By virtue of particular coupling assemblies, the structural members of the folding chair of the present invention are adapted to be moved in one or both of two perpendicular directions. Accordingly, the chair may be folded so that the structural members thereof can be arranged in substantially parallel alignment with one another and generally in a single plane.

A FOURTH EXAMPLE, U.S. Pat. No. 4,585,270 to Singer teaches a substantially rigid support structure for a piece of furniture, having a pair of transversely spaced struts in substantially fixed relationship to each other, the axes of the struts being inclined with respect to the horizontal, an integral rigid member having two upper ends spaced from each other and two lower ends spaced from each other and being oppositely inclined with respect to the horizontal and positioned intermediate the struts, and a plurality of tension members interconnecting the struts and the rigid member to form a substantially rigid structure.

A FIFTH EXAMPLE, U.S. Pat. No. 4,614,378 to Picou teaches a portable reversible chair apparatus with pivotal connections enabling the device to be converted from a "posture" chair configuration to a conventional chair configuration simply and quickly. While the device is in the "posture" chair configuration adjustments are possible that allow users of different size to select the seat angle and the seat to knee rest distance which is most comfortable for them. The knee rest is designed to flex in the vertical plane allowing the seated user to shift weight and position comfortably and safely. The critical joints of the chair pivot thus eliminating racking of joints. Rigidity is derived from triangulation rather than from the size of the joints. The device is very stable due to its large base and sits well on an uneven surface because it rests on three points rather than the traditional four.

A SIXTH EXAMPLE, U.S. Pat. No. 4,652,047 to Chan teaches a folding chair provided with 8 rods, 4 of which stand vertically a distance apart defining the four corners of the chair and four of which are diagonally crossed and pivotally secured to each other near their midpoints. The lower end of each diagonal rod is connected to the lower portion of a vertical rod and the upper end of the diagonal rod is connected to the upper portion of the vertical rod located at the corner diagonally opposite the first vertical rod. A seat bottom comprised of flexible material and two bracing rods is supported at four corners where the upper ends of the diagonal rods meet the vertical rods. Arm and back supports of a flexible material are supported by portions of the vertical rods extending upward beyond the seat level. Each vertical rod is connected to a diagonal rod in two locations. In the first embodiment, one connection is a releasable joint and the other connection is pivoted joint. In the second embodiment, two pivoted joints on each vertical rod are allowed to move towards and away from each other by means of an expanding and contracting rod. Both of these constructions permit the chair to be collapsed into a compact linear storage configuration in which the diagonally crossed rods pivot into a position alongside one another while the vertical rods assume a position alongside the diagonal rods.

A SEVENTH EXAMPLE, U.S. Pat. No. 5,718,473 to Lynch, Jr. teaches a folding chair that comprises a front, scissors-like X-structure formed by two pivotally coupled rigid members, the lower ends of which form front feet and the upper ends of which form front seat corners of the chair. Rearward the scissors structure, and inverted Y-structure includes a pair of downwardly depending rear legs diverging from a central hinge to form rear feet and a stile pivotally coupled to the hinge and extending upwardly opposite the legs. Two spindles link the front feet to an apex coupled to the hinge by a tether, and two lateral braces link the rear feet to the front sear corners, the braces and the spindles being pivotally coupled together where they cross. The stile opposite the hinge includes a transverse rail from which is suspended a hammock seat extending downward to the front seat corners on the scissors structure. The chair folds to a tight bundle for carrying, the hammock seat doubling as a shoulder sling. The chair quickly deploys by spreading the front feet, thereby causing the rear feet to spread apart and to extend rearwardly from the front feet. The stile, folded downwardly between the rear legs for carrying, pivots upwardly at the hinge and latches into place to support the upper end of the hammock.

It is apparent that numerous innovations for chairs have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a chair frame that avoids the disadvantages of the prior art.

ANOTHER OBJECT of the present invention is to provide a chair frame that is simple and inexpensive to manufacture.

STILL ANOTHER OBJECT of the present invention is to provide a chair frame that is simple to use.

BRIEFLY STATED, YET ANOTHER OBJECT of the present invention is to provide a chair frame that includes a seat portion, a seat back portion extending upwardly from the seat portion, a plurality of legs depending from the seat portion, and bracing extending from the plurality of legs. The seat portion includes a front seat rail, a rear seat rail, and a pair of side seat rails that form a continuous rectilinear configuration for the seat portion. The seat back portion includes a pair of stiles and a back rail, and together with the rear seat rail, forms a continuous rectilinear configuration for the seat back portion. The plurality of legs include a pair of front legs and a pair of back legs. The bracing includes a rear stretcher and a pair of diagonal braces. Each diagonal brace extends from the free terminal end of an associated rear leg to the midpoint of the front seat rail, and together with the rear stretcher of the bracing, forms a triangular configuration for the bracing.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

Figures 1, 2, 3, 4, 5:
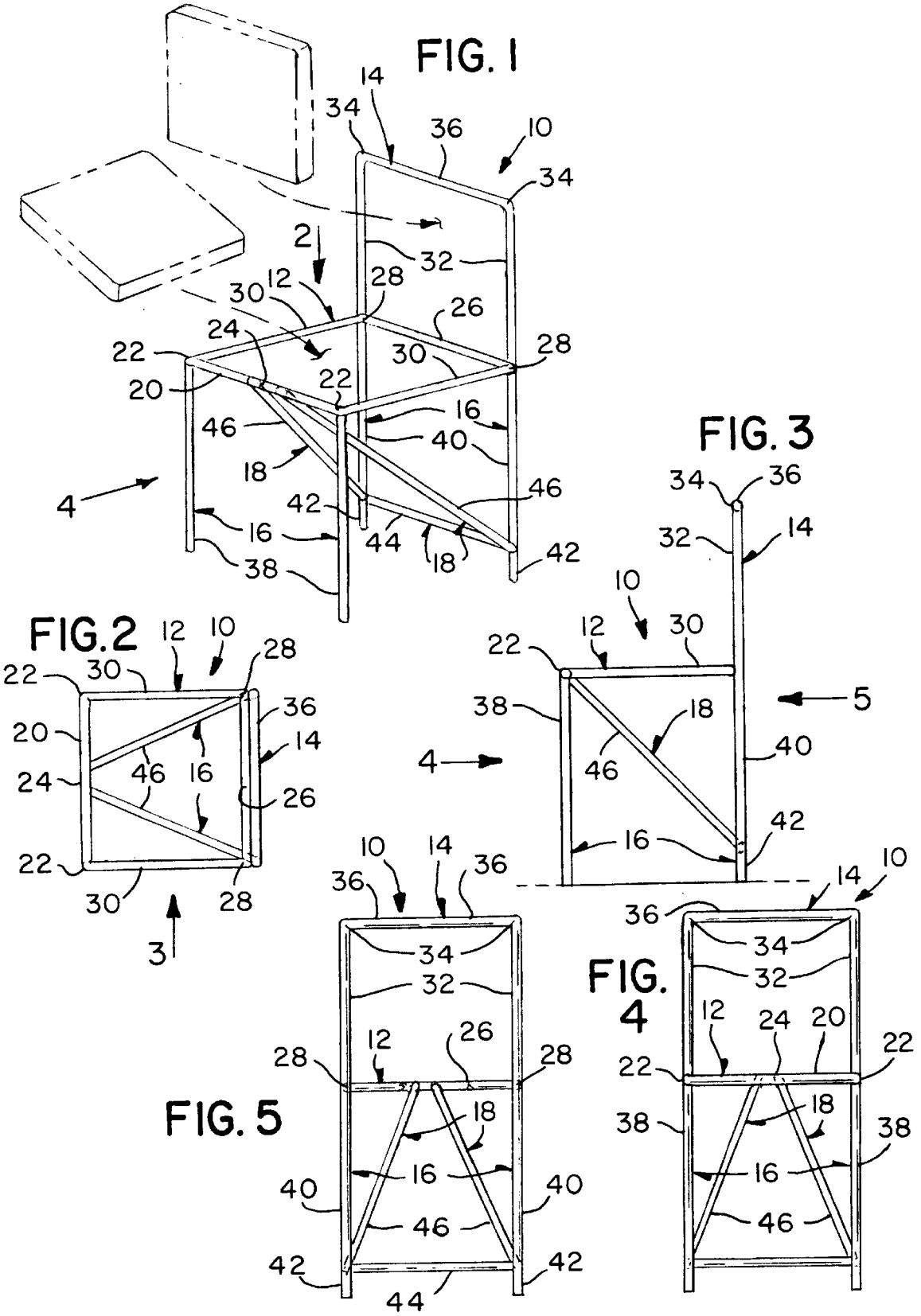
FIG. 1 is a diagrammatic perspective view of the present invention.
FIG. 2 is a diagrammatic top plan view taken generally in the direction of arrow 2 in FIG. 1.
FIG. 3 is a diagrammatic side elevational view taken generally in the direction of arrow 3 in FIG. 2.
FIG. 4 is a diagrammatic front elevational view taken generally in the direction of arrow 4 in FIG. 3.
FIG. 5 is a diagrammatic rear elevational view taken generally in the direction of arrow 5 in FIG. 3.

| LIST OF REFERENCE NUMERALS UTILIZED IN THE DRAWING | |
|---|---|
| 10 | chair frame of the present invention |
| 12 | seat portion |
| 14 | seat back portion |
| 16 | plurality of legs 16 |
| 18 | bracing |
| 20 | front seat rail of seat portion 12 |
| 22 | pair of terminal ends of front seat rail 20 of seat portion 12 |
| 24 | midpoint of front seat rail 20 of seat portion 12 |
| 26 | rear seat rail of seat portion 12 |
| 28 | pair of terminal ends of rear seat rail 26 of seat portion 12 |
| 30 | pair of side seat rails of seat portion 12 |
| 32 | pair of stiles of seat back portion 14 |
| 34 | terminal end of each stile of pair of tiles 32 of seat back portion 14 |
| 36 | back rail of seat back portion 14 |
| 38 | pair of front legs of plurality of legs 16 |
| 40 | pair of rear legs of plurality of legs 16 |
| 42 | free terminal end of each rear leg of pair of rear legs 40 of plurality of legs 16 |
| 44 | rear stretcher of bracing 18 |
| 46 | pair of diagonal braces of bracing 18 |

DETAILED DESCRIPTION OF THE PREFERRED EMBODIMENT

Referring to the figures, in which like numerals indicate like parts, and particularly to FIG. 1, the chair frame of the present invention is shown generally at 10.

The configuration of the chair frame 10 can best be seen in FIGS. 1–5, and as such, will be discussed with reference thereto.

The chair frame 10 comprises a seat portion 12, a seat back portion 14 extending upwardly from the seat portion 12, a plurality of legs 16 depending from the seat portion 12, and bracing 18 extending from the plurality of legs 16.

The seat portion 12 comprises a front seat rail 20 that has a pair of terminal ends 22 and a midpoint 24 that is midway between the pair of terminal ends 22 of the front seat rail 20.

The seat portion 12 further comprises a rear seat rail 26 that has a pair of terminal ends 28 and is spaced behind the front seat rail 20 of the seat portion 12.

The seat portion 12 further comprises a pair of side seat rails 30. Each side seat rail 30 of the seat portion 12 extends from an associated terminal end 22 of the front seat rail 20 to an associated terminal end 28 of the rear seat rail 26 so as to form a continuous rectilinear configuration for the seat portion 12.

The seat back portion 14 comprises a pair of stiles 32. Each stile 32 of the seat back portion 14 extends upwardly from an associated terminal end 28 of the rear seat rail 26 to a terminal end 34.

The seat back portion 14 further comprises a back rail 36 that extends from the terminal end 34 of one stile 32 to the terminal end 34 of the other stile 32, and together with the pair of stiles 32 of the seat back portion 14 and the rear seat rail 26 of the seat portion 12, forms a continuous rectilinear configuration for the seat back portion 14.

The plurality of legs 16 comprise a pair of front legs 38. Each front leg 16 depends from an associated terminal end 22 of the front seat rail 24.

The plurality of legs 16 further comprise a pair of rear legs 40. Each rear leg 40 depends from an associated terminal end 28 of the rear seat rail 24 to a free terminal end 42, and is collinear with an associated stile 32 of the seat back portion 14.

The bracing 18 comprises a rear stretcher 44 that extends from the free terminal end 42 of one rear leg 40 to the free terminal end 42 of the other rear leg 40.

The bracing 18 further comprises a pair of diagonal braces 46. Each diagonal brace 46 of the bracing 18 extends from the free terminal end 42 of an associated rear leg 40 to the midpoint 24 of the front seat rail 20, and together with the rear stretcher 44 of the bracing 18, forms a triangular configuration for the bracing 18.

The triangular configuration effectively triangulates the seat portion 12. Upon tilting back on the pair of rear legs 40, the pair of diagonal braces 46 compress by virtue of the seat portion 12. The joints between the front seat rail 24, the diagonal braces 46, and the pair of rear legs 40 are strengthened by being forced together. This prevents the seat portion 12 from breaking downwards at its critical joint with the seat back portion 14. The triangular configuration also prevents wracking (side-to-side twisting) of the seat portion 12. The rear stretcher 44 limits the effect of someone tilting the chair to the side while seated.

It will be understood that each of the elements described above, or two or more together, may also find a useful application in other types of constructions differing from the types described above.

While the invention has been illustrated and described as embodied in a chair frame, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A chair frame, comprising:

a) a seat portion comprising:

i) a front seat rail having:

1) a pair of terminal ends; and 2) a midpoint being midway between said pair of terminal ends of said front seat rail; and ii) a rear seat rail having a pair of terminal ends, and being spaced behind said front seat rail of said seat portion;

b) a seat back portion extending upwardly from said seat portion; said seat back portion comprising a pair of stiles; each stile of said seat back portion extending upwardly from an associated terminal end of said rear seat rail, to a terminal end;

c) a plurality of legs depending from said seat portion; said plurality of legs comprising a pair of rear legs; each rear leg depending from an associated terminal end of said rear seat rail to a free terminal end, and being collinear with an associated stile of said seat back portion; and d) bracing extending from said plurality of legs; said bracing comprising a pair of diagonal braces; each diagonal brace of said bracing extending from said free terminal end of an associated rear leg to said midpoint of said front seat rail, and together with said rear stretcher of said bracing, forming a triangular configuration for said bracing, with said triangular configuration effectively triangulating said seat portion, so that upon tilting back on said pair of rear legs, said pair of diagonal braces compress by virtue of said seat portion, and joints between said front seat rail, said diagonal braces, and said pair of rear legs are strengthened by being forced together, which prevents said seat portion from breaking downwards at its critical joint with said seat back portion, and with said triangular configuration also preventing wracking, which is side-to-side twisting, of said seat portion, and with said rear stretcher limiting effects of someone tilting said chair frame to a side while seated.

2. The frame as defined in claim 1, wherein said seat portion further comprises a pair of side seat rails; each side seat rail of said seat portion extends from an associated terminal end of said front seat rail to an associated terminal end of said rear seat rail so as to form a continuous rectilinear configuration for said seat portion.

3. The frame as defined in claim 1, wherein said seat back portion further comprises a back rail that extends from said terminal end of one stile to said terminal end of the other stile, and together with said pair of stiles of said seat back portion and said rear seat rail of said seat portion, forms a continuous rectilinear configuration for said seat back portion.

4. The frame as defined in claim 1, wherein said plurality of legs comprise a pair of front legs; each front leg depends from an associated terminal end of said front seat rail.

5. The frame as defined in claim 1, wherein said bracing comprises a rear stretcher that extends from said free terminal end of one rear leg to said free terminal end of the other rear leg.

* * * * *